United States Patent [19]

Fell et al.

[11] 3,987,931

[45] Oct. 26, 1976

[54] PREPARATION OF FLAT ITEMS FOR AUTOMATIC DISPENSING

[75] Inventors: Wolfgang Fell; Lothar Märtin, both of Constance, Germany

[73] Assignee: Licentia Patent-Verwaltungs-G.m.b.H., Frankfurt am Main, Germany

[22] Filed: Apr. 16, 1975

[21] Appl. No.: 568,525

[30] Foreign Application Priority Data

Apr. 24, 1974 Germany ..... 2419737

[52] U.S. Cl. ..... 221/73; 229/69; 206/526

[51] Int. Cl.[2] ..... B65H 5/28

[58] Field of Search ..... 221/70–74, 221/30; 206/390, 330, 461, 476, 525, 820; 156/584; 312/91; 229/69

[56] References Cited

UNITED STATES PATENTS

| | | | |
|---|---|---|---|
| 3,027,047 | 3/1962 | Johnson | 221/73 |
| 3,250,385 | 5/1966 | Timms | 206/820 |
| 3,369,952 | 2/1968 | Rieget | 221/73 |
| 3,450,307 | 6/1969 | Sutton | 221/74 |
| 3,674,176 | 7/1972 | Sagi | 221/70 |

*Primary Examiner*—Robert B. Reeves
*Assistant Examiner*—H. Grant Skaggs
*Attorney, Agent, or Firm*—Spencer & Kaye

[57] ABSTRACT

Flat items, such as envelopes, having some degree of inherent resiliency are prepared for dispensing by releasably fastening them to one side of a support tape along the length thereof, in a manner such that successive items are fastened at successive sections along the tape, by then folding the tape to place the items in a single stack, and by placing this stack in a storage shaft with one end of the tape protruding from the shaft, and the items are dispensed by pulling the successive sections of the tape out of the shaft, starting with such one end, deflecting each such successive section of the tape over a guide surface in a manner to deflect the tape away from the item fastened at the point within that section, and guiding the item in a manner to cause the deflection of the tape away from the item to result in release of the item from the tape.

12 Claims, 5 Drawing Figures

PREPARATION OF FLAT ITEMS FOR AUTOMATIC DISPENSING

BACKGROUND OF THE INVENTION

The present invention relates to a method for preparing, and subsequently stacking and reseparating, flat items, particularly for the purpose of dispensing them from an automatic dispenser, as well as to apparatus for practicing the method.

Items of the type under consideration may be flat envelopes, for example of plastic, each containing, for example, a bill or several bills, cards or the like. When separating the stack, interference with a smooth flow and double removals must be substantially eliminated, these being faults which may be caused, in particular, by deviations in the shape of the individual items as a result of varying contents of the envelopes, for example.

SUMMARY OF THE INVENTION

To satisfy these requirements in a particularly suitable manner, the present invention provides that one flat side of each item to be stacked is releasably attached to the same side of a common tape so that the items can be stacked while forming a zigzag band. The items are then stacked in this form in a shaft, a free end of the tape leading out of the shaft, and the tape is pulled out of the shaft in sections over a guide surface which deflects the tape from the item carried at this point, the partially supported item being removed from the tape at this moment by a guide element which is independent of the tape.

DESCRIPTION OF THE PREFERRED EMBODIMENTS

Figure 1A:
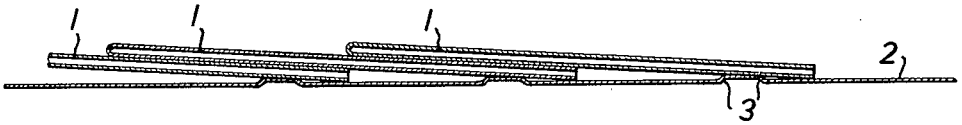
FIGS. 1*a* and 1*b* are side and plan views, respectively, of a plurality of identical flat items which are fastened to a common tape for the purpose of subsequent stacking and reseparation by spot welding.
Figure 1B:
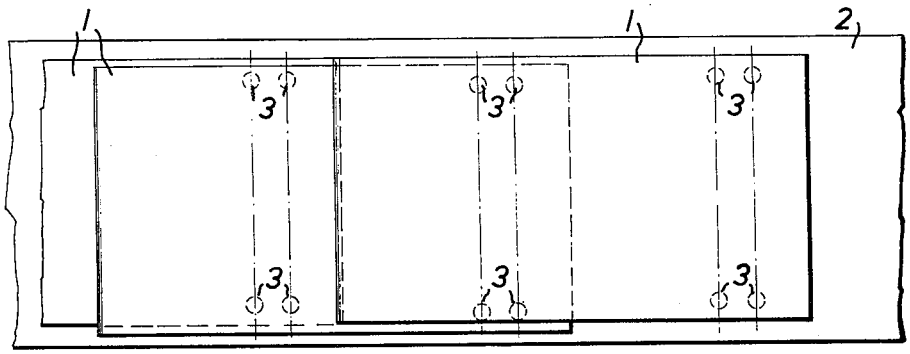

FIGS. 1*a* and 1*b* show, from the side and top, respectively a plurality of identical flat items 1, which may each be a flat plastic envelope containing one or a plurality of bills. Hereinafter these items will be called "envelopes." The envelopes 1 are shown to be stacked in an overlapping manner, much like the scales of a fish, and are fastened at equally spaced intervals to the same side of a common thin tape 2 by light spot welding, heat sealing, or cementing. Every pair of welding dots 3 is disposed near a respective edge of the envelope which is parallel to the longitudinal direction of the tape, and in the same zone of each envelope. The straight lines perpendicular to the longitudinal direction of the tape, and passing through corresponding welding dots 3 at opposite sides of the tape define a strip on each envelope transverse to the longitudinal direction of the tape. In the drawing, the strip associated with each envelope is located near, but spaced at least a small distance from, the right-hand edge of the envelope, which during the later separation is to be the leading edge of the envelope. The center of gravity of each envelope is always to the left of this zone.

Tape 2 is a very thin foil which may have a thickness of 30$\mu$, for example and be made of plastic, for example of polyethulene, it being assumed, in order to be able to spot weld them, that the envelopes are also made of polyethylene or are coated with this material at the side where they are to be fastened.

Figure 2A:
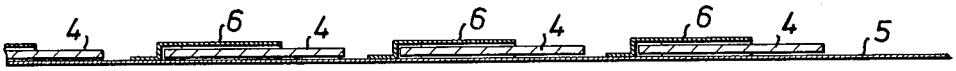
FIGS. 2*a* and 2*b* are views similar to those of FIGS. 1*a* and 1*b* of a plurality of flat items which are connected with the tape for the above-mentioned purpose in that they are inserted in a pocket in said tape.
Figure 2B:
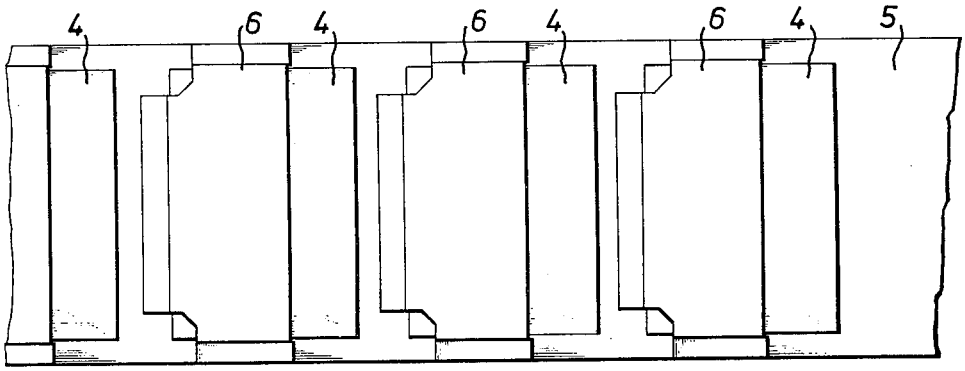

FIG. 2*b* is a top view of another type of fastening of flat items 4 to a tape 5, while FIG. 2*a* is a cross-sectional view along the center line of this tape. The tape is again a very thin foil of the above-mentioned type and the right-hand edges of the items 4 are to be the leading edges during the later separation stage. On one side of tape 5, pockets 6 made of the same foil are welded to the tape and items 4 are inserted thereinto in such an arrangement that the portions of the items 4 pointing toward the right protrude from the pocket and rest with one flat side on tape 5.

Figure 3:
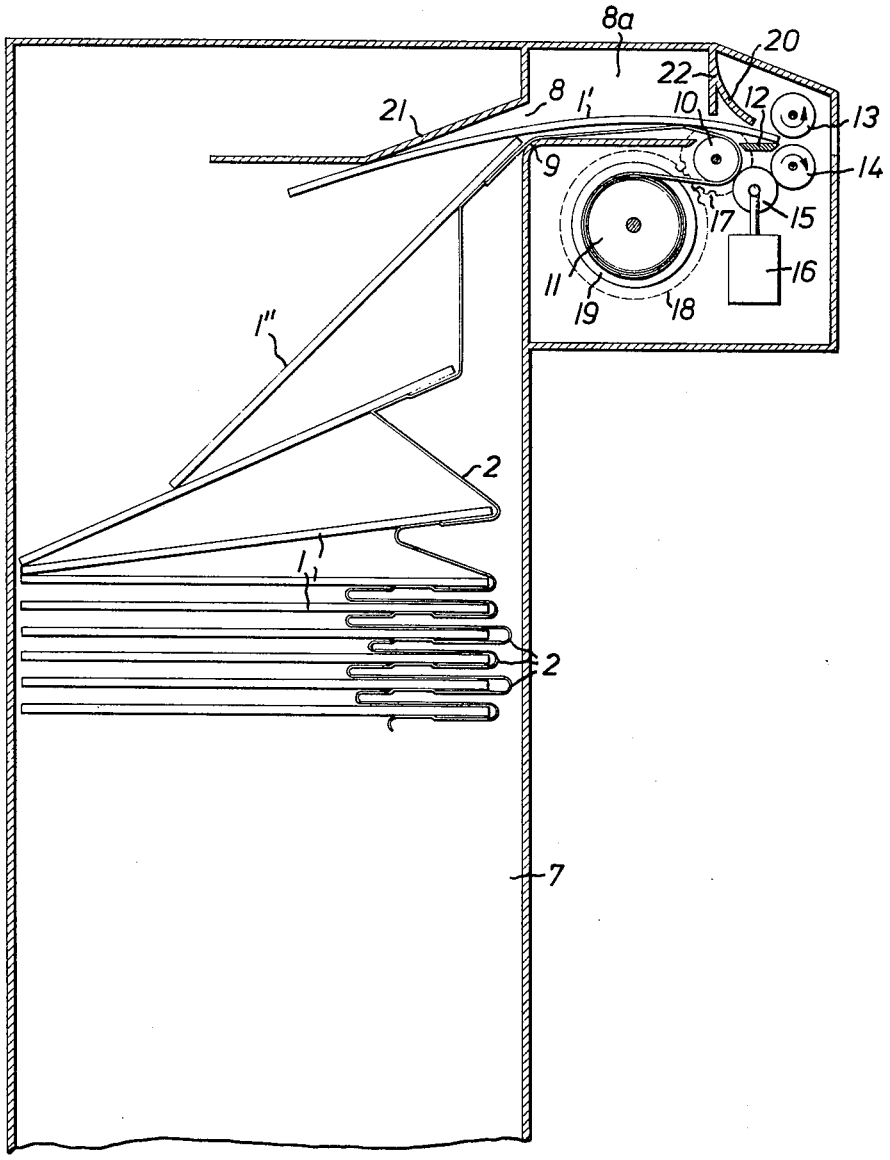
FIG. 3 is a side elevational vew of a stacking shaft and a separating device with items processed in the manner shown in FIGS. 1*a*, 1*b*, part of which are stacked and part of which are on their way to separation.

FIG. 3 shows the interior of a vertical shaft 7 in which envelopes 1 which have been assembled in the manner shown in FIGS. 1*a* and 1*b* by being spot welded to a thin tape 2 are stacked one on top of the other. Only part of the stack is shown. The envelopes are stacked in such a manner that their flat sides which are welded to tape 2 all point toward the bottom. The thin tape 2 is folded in a zigzag arrangement in the manner of a bellows so that for the tape portion associated with each envelope, one crease always comes to lie near the edge of the envelope, while a second crease lies between that envelope and the one thereinabove, the intended leading edges of all of the envelopes lying at the same side of the shaft, in FIG. 3 on the right-hand side, one on top of the other.

At the right side of the shaft 7, at its upper portion, there is an exit opening 8 which defines the inlet end of a discharge channel 8*a*. The free end of tape 2, in FIGS. 1*a* and 1*b* this end being disposed at the right and being of sufficient length, is pulled out and deflected by a deflection surface 9 which brings the tape into an approximately horizontal orientation. Then the tape is wound around a guide roller 10 and deflected through an angle of about 180° whereupon it is wound on a windup roller 11. The cylindrical surface of roller 10 constitutes a separation surface which moves tape 2 away from the path of the envelope 1 fastened to the tape section then adjacent roller 10.

At the right-hand side of the horizontal path of movement of tape 2 there is provided a stationary horizontal table surface 12 immediately behind the guide roller 10.

In the same direction of movement of the tape, immediately behind the table surface 12, two conveying rollers 13 and 14 form a conveying gap which is disposed directly above the table surface. The conveying rollers 13 and 14 are continuously driven by a drive (not shown) so that conveying roller 13 rotates counterclockwise and conveying roller 14 rotates clockwise. Rollers 13 and 14 and table surface 12 together constitute guide means for guiding each envelope 1 in a direction away from the direction in which tape 2 is conveyed by roller 10. A pressure roller 15 is supported by a lifting magnet 16 and is positioned so as to be pressed against conveying roller 14 and also against guide roller 10 and the tape 2 wound thereabout when lifting magnet 16 is actuated. In this position the pressure roller 15 is driven by roller 14 and in turn drives guide roller 10 and tape 2.

Guide roller 10 is permanently connected with a toothed wheel, or gear, 17 which meshes with a gear 18 rotatable on the shaft of windup roller 11. Gear 18 is connected with the drive portion of a slip clutch 19 (shown only schematically) which is coaxial with the gear 18, while the driven portion of the slip clutch is connected with the windup reel 11 of tape 2.

In order to separate the envelopes 1 stacked in shaft 7 and to bring only one envelope at a time to the point of discharge, magnet 16 can be temporarily actuated for a predetermined time sufficient to pull a sufficient length of tape 2 out of shaft 7 to dispense one envelope.

FIG. 3 shows a stage of the separation process in which an envelope 1' which is fastened to tape 2 has been pulled, together with the tape, about deflection surface 9 into a substantially horizontal direction and now has its leading edge positioned above table surface 12 since envelope 1' has certain inherent stiffness which assures that its leading portion will move in the horizontal direction while the portion of the tape 2 pulling the envelope has already been deflected toward the bottom by guide roller 10. This deflection breaks the spot weld connections at the two lines extending between spots perpendicular to the tape length in succession so that the envelope is gripped by the two conveying rollers 13 and 14 at the latest before the two weld spots at the trailing end of the fastening strip have broken, and is transported to the right by these two conveying rollers and out of the discharge channel 8*a*. If during this break-off process, a spot weld does not break as intended, a hold can also be torn in tape 2 which, as mentioned above, is very thin, without interrupting the separation process.

As can be seen in FIG. 3 the substantially horizontal envelope 1' has now been given a curvature in that its portion which is fastened to tape 2 has been pulled by tape 2 toward the right past a guide sheet 20, while on the other hand its center portion is supported by deflection surface 9 and its rear portion must slide along a guide sheet 21 so that this rear portion is pressed downwardly and produces the illustrated curved shape of the envelope in longitudinal direction.

This is a safety measure that serves to assure that an envelope which may have for some reason come loose from the tape and which is being carried along while resting on top of another envelope is prevented from being discharged. The leading edge of such an envelope would then not be pulled into the horizontal position, but would continue to advance without being given a curvature so that its leading edge would come to abut against an abutment sheet 22 and the envelope would thus be prevented from moving any further.

Once the following envelope which is being properly transported by the tape has been pulled out, the envelope held back by abutment sheet 22 slides over the next following envelope which is properly fastened to tape 2, which is then approximately in position 1'' and this is repeated until the shaft is empty. Once the shaft is empty, the envelope which has been held back by abutment sheet 22 can return into the shaft.

When during use, shaft 7 becomes progressively more empty, each envelope will be more steeply inclined at position 1'' than the preceding envelope and it can be seen that it is advisable for the envelopes to hang from tape 2 with their centers of gravity below the fastening zone in the position discussed above. Fastening with weld spots that define forming a transverse strip as shown in FIGS. 1*a*, 1*b* has the advantage that the formation of a zigzag, or pleated, tape is favored and a good fastening is possible which nevertheless is light at the individual dots and which can be broken in two steps so that the second step dependably occurs after the envelope has come into the range of conveying rollers 13, 14.

It can be seen that the separating device of FIG. 3 can, in a manner which is similar in principle, also separate flat items 4 which, as shown in FIGS. 2*a* and 2*b* are fastened to a tape 5 by being inserted in pockets 6. The free, or leading, portion of each item 4 which moves horizontally toward conveying rollers 13 and 14 must then be gripped by rollers 13, 14 and the item must be pulled out of pocket 6 by sufficiently fast movement of rollers 13, 14 before the leading portion of the pocket has been deflected downwardly around guide roller 10.

In the case of the embodiment shown in FIGS. 2*a*, and 2*b* a length of tape 5 carrying items 4 will be folded and stacked in shaft 7 in such a manner that there will be only one crease in tape 4 between each adjacent pair of items, successive creases will be at respectively opposite sides of the shaft, and successive items will face upwardly and downwardly, respectively, from tape 4. Thus, the first item at the right in FIGS. 2*a* and 2*b* would face upwardly from tape 5, the next item would face downwardly from the tape, the next item would face upwardly, etc.

It will be understood that the above description of the present invention is susceptible to various modifications, changes and adaptations, and the same are intended to be comprehended within the meaning and range of equivalents of the appended claims.

What is claimed is:

1. Apparatus for dispensing flat items individually in succession, a plurality of such items being releasably fastened to one side of a support tape in a manner such that the items are spaced along the length of the tape and each item is fastened at a region of the tape located in a respective successive section of the tape, and the tape being folded along fold lines transverse to its length to form a pleated tape having the fastened items stacked one atop the other; said apparatus comprising:

means defining a storage receptacle having a side wall provided with a lateral discharge opening located in the region of its upper end, the pleated tape being disposed in said receptacle with the end thereof adjacent the uppermost item of the stack passing through the opening;

means composed of a driven roller whose cylindrical surface constitutes a separation surface disposed outside said receptacle and arranged to more the tape in a first direction, said separation surface being located in a manner such that it faces the side of the tape opposite the one side at which the items are releasably fastened;

a pressing roller arranged to press the tape against said separation surface for permitting the tape to be advanced by rotation of said guide roller and said pressing roller; and guide means disposed for guiding each item in a second direction when the section of tape associated with that item is being moved in the first direction along said separation surface, the angle between said first and second directions being such as to cause each such item to be released from the tape, wherein said guide means comprise roller drive means including a driven roller for transporting each item in the second direction and wherein said pressing roller is mounted to press against said driven roller at the same time as it presses the tape against said guide roller.

2. Apparatus as defined in claim 1 wherein said guide means further includes means defining a surface which supports the leading portion of each item during movement in the second direction.

3. Apparatus for dispensing flat, flexible items individually in succession, a plurality of such items being releasably fastened to one side of a support tape in a manner such that the items are spaced along the length of the tape and each item is fastened at a region of the tape located in a respective successive section of the tape, and the tape being folded along fold lines transverse to its length to form a pleated tape having the fastened items stacked one atop the other; said apparatus comprising:

means defining a storage receptacle having a side wall provided with a lateral discharge opening located in the region of its upper end, the pleated tape being disposed in said receptacle with the end thereof adjacent the uppermost item of the stack passing through the opening;

means defining a separation surface disposed outside said receptacle and arranged to move the tape in a first direction, said surface being located in a manner such that it faces the side of the tape opposite the one side at which the items are releasably fastened; j guide means disposed for guiding each item in a second direction when the section of tape associated with that item is being moved in the first direction along said separation surface, the angle between said first and second directions being such as to cause each such item to be released from the tape;

an abutment member disposed for preventing items which are not properly fastened to the tape from passing completely through said discharge opening; and means defining a guide surface for bending each item as it passes through said discharge opening and before its leading edge reaches said guide means.

4. Apparatus for dispensing flat items individually in succession, a plurality of such items being releasably fastened to one side of a support tape in a manner such that the items are spaced along the length of the tape and each item is fastened at a region of the tape located in a respective successive section of the tape, said apparatus comprising:

means defining a storage receptacle having a side wall provided with a discharge opening located in the region of its upper end, said receptacle presenting a deflection surface for guiding the tape out of said receptacle, the tape being disposed in said receptacle, below said discharge opening and said deflection surface, in a configuration such that the tape is folded along fold lines transverse to its length to form a pleated tape having the fastened items stacked one atop the other, the end of the pleated tape adjacent the uppermost item of the stack passing through the discharge opening;

means defining a separation surface for deflecting the tape away from the path defined between said deflection surface and said separation surface; and conveyor roller means including at least one driven roller arranged to grip each item beyond the region of deflection of the tape from such path and to convey the item away from said separation surface, the movement imparted to the item by said conveyor roller means and the deflection of the tape by said separation surface acting to cause the item to be released from the tape.

5. Apparatus as defined in claim 4 wherein each item is fastened to the tape only at points which during dispensing of an item are near the leading edge of the item, at least two of the points being spaced apart in the direction of cnveyance of the item, and said conveyor roller means are located to grip each item at a moment when the item has been separated from the tape at less than all of such fastening points.

6. Apparatus as defined in claim 4 wherein the items are fastened to the tape with a mutual spacing such that successive items overlap one another when the tape is in its extended condition.

7. Apparatus as defined in claim 4 wherein said means defining a separation surface cooperate with said conveyor roller means for conveying items, during release from the tape, in a direction different from the direction of movement of the tape.

8. Apparatus as defined in claim 7 wherein the items are flexible and further comprising means defining a guide surface for bending each item as it passes through said discharge opening and before its leading edge reaches said conveyor roller means.

9. Apparatus as defined in claim 7 wherein said means defining a separation surface comprises a driven guide roller whose cylindrical surface constitutes said separation surface, and further comprising a pressing roller arranged to press the tape against said surface for permitting the tape to be advanced by rotation of said rollers.

10. Apparatus as defined in claim 7 wheren said means defining a separation surface comprises a guide roller having an outer cylindrical surface defining said separation surface and further comprising a windup roller for winding up the tape as it passes said separation surface, and a slip clutch connected between said guide roller and said windup roller for transmitting rotational drive power from said guide roller to said windup roller.

11. Apparatus as defined in claim 7 further comprising means defining a first guide surface disposed ahead of said separation surface, with respect to movement of the tape in said first direction, said guide surface guiding the tape in a substantially unchanging direction.

12. Apparatus as defined in claim 7 further comprising an abutment member disposed for preventing items which are not properly fastened to the tape from passing completely through said discharge opening.

* * * * *